US006263549B1

(12) United States Patent
Uehara

(10) Patent No.: US 6,263,549 B1
(45) Date of Patent: Jul. 24, 2001

(54) BUCKLE WITH REINFORCING RIDGE AND GROOVE

(75) Inventor: Ryoichiro Uehara, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 09/410,685

(22) Filed: Oct. 1, 1999

(30) Foreign Application Priority Data

Oct. 22, 1998 (JP) ..... 10-300453

(51) Int. Cl.[7] ..... A44B 11/26
(52) U.S. Cl. ..... 24/625
(58) Field of Search ..... 24/614, 615, 616, 24/625; D11/216, 218

(56) References Cited

U.S. PATENT DOCUMENTS 4,662,040 * 5/1987 Terrell et al. .
5,465,472 * 11/1995 Matoba .
5,507,076 * 4/1996 Anscher .
5,590,444 * 1/1997 Krauss .
5,791,026 * 8/1998 Anscher .
5,794,316 * 8/1998 Anscher .
5,996,192 * 12/1999 Haines et al. .
6,052,875 * 4/2000 Fudaki .

FOREIGN PATENT DOCUMENTS 2 293 201 3/1996 (GB) .

* cited by examiner

*Primary Examiner*—James R. Brittain
(74) *Attorney, Agent, or Firm*—Finnegan, Henderson, Farabow, Garrett & Dunner, L.L.P.

(57) ABSTRACT

A buckle having a buckle main body and an insertion body. The buckle main body comprises an upper plate, a lower plate, and side walls. The buckle main body also has an insertion port at one end and a belt-mounting portion at the other end. The insertion body has flexible operation rods on both sides of a base rod in a projecting manner where portions of the operation rods are to be engaged in the insertion port of the buckle main body. The operation rods have narrow leg portions arranged in a side of the base rod, and bulging head portions fitted to opening portions and formed in the front end of the leg portions. Reinforcing ridge portions are formed on the outer surface of the leg portions running from substantially the base rod to substantially the bulging head portions.

5 Claims, 8 Drawing Sheets

BUCKLE WITH REINFORCING RIDGE AND GROOVE

BACKGROUND OF THE INVENTION

1. Field of the Invention

The present invention relates to a buckle of an insert type comprising female and male members, that is, a buckle main body and an insertion body, and particularly to a buckle for fastening a belt, which is generally used for a clothing, a bag, a helmet, a stroller, a sports equipment or the like.

2. Description of the Prior Art

Conventionally, this kind of buckle is constituted by a buckle main body and an insertion body structured such as that shown in FIG. 11, the buckle main body 101 is formed in a flat cylindrical shape comprising an upper plate 103, a lower plate 104 and side walls 105, is provided with an insertion port 106 in one end, a belt mounting portion 107 on the other end and opening portions 109 in both side surfaces, and is provided with two guide ribs on inner surfaces of the upper plate 103 and the lower plate 104, and the insertion body 102 is provided with a belt mounting portion 107 projected from one end thereof, operation rods 125 projected from both sides of the other end thereof and a guide rod projected from a center thereof. In the buckle structured in the manner mentioned above, an expanding operation portion 129 capable of fitting to the opening portion 109 is provided at a front end of each of the operation rods 125 so as to form an engaging portion, a thin elastic piece is provided from a base portion of the belt mounting portion 107 to the operation portion 129 so as to provide flexibility, a rib is provided in an inner side of the operation portion 129 so as to reinforce, and the guide rod is fitted and inserted between the guide ribs of the upper plate 103 and the lower plate 104. This kind of buckle is disclosed in Japanese Patent Laid-Open Publication No.7-250704.

Further, the insertion type buckle shown in FIG. 12 is constituted by a buckle main body 1' which is structured such that an upper plate 4' and a lower plate 3' are connected by a guide piece provided in a vertical direction at a center thereof, an insertion port 6' and a belt mounting portion are respectively provided at one end and the other end thereof, opening portions 9' continued to the insertion port 6' are formed on both side surfaces, deep recess grooves are provided on inner surfaces of the upper plate 4' and the lower plate 3' along a guide piece from the insertion port 6' and inward hook-shaped portions 10' to be engaged are provided in both sides thereof in a vertical symmetrical manner, and an insertion body 2' which is structured such that a belt mounting portion 7' is provided in one end thereof, flexible insertion leg portions projecting from both sides of a base portion 19' of the belt mounting portion 7' are provided in the other end thereof, a pair of short vertically protruding portions 30' having a great height are projected from a center of the base portion 19' so as to form a groove portion 31' therebetween, operation portions 25' are formed on outer side surfaces of the curved insertion leg portions, the operation portions 25' are continuously formed from the base portion 19' at a substantially equal thickness and outward hook-shaped engaging portions 29' are provided in inner sides of the front ends of the insertion leg portions in a vertically symmetrical manner. In this structure, the insertion leg portion of the insertion body 2' is inserted from the insertion port 6' of the buckle main body 1' so as to engage the engaging portion 29' with the portion 10' to be engaged. This type of buckle is disclosed in Japanese Patent Laid-Open Publication No. 7-289310.

In the buckle shown in FIG. 11, in the case of inserting the insertion body 102 to the buckle main body 101 so as to engage the engaging portion with the portion 110 to be engaged for use, when a strong tensile force is applied between the buckle main body 101 and the insertion body 102, there is a risk that a shearing force is applied between the elastic piece and the operation portion 129 in the operation rod 125 of the insertion body 102 and a crack may generate, and there is also a risk of breaking the thin elastic piece. Further, there is a problem that it is hard to hold the elastic piece of the operation rod 125 against the side walls 105 of the buckle main body 110 in a stable state at a time of engaging.

Further, in the buckle shown in FIG. 12, since the buckle main body 1' does not have means for positively guiding the insertion leg portion at a time of inserting the insertion body 2' into the buckle main body 1' and a pair of projections 30' inserted to the guide piece have a short length, an inserting operation of the insertion body 2' is significantly unstable and troublesome. Still further, since the inner surface of the buckle main body 1' and the insertion body 2' are formed in an inside and outside symmetrical manner, it is possible to insert the insertion body 2' to the buckle main body 1' in an opposite direction, so that there is a problem of a risk that the belt mounted to the insertion body 2' is twisted in place of a normal condition.

SUMMARY OF THE INVENTION

The present invention is made by taking the problems mentioned above into consideration, and a main object of a first aspect of the present invention is to provide a buckle of a type inserting an insertion body formed by operation rods provided with engaging portions in both sides thereof to a buckle main body formed in a flat cylindrical body and provided with portions to be engaged in both sides thereof so as to engage the insertion body with the buckle main body, in which leg portions in the operation rods are reinforced, a crack or a breakage near the engaging portion is previously prevented and side walls of the buckle main body securely hold the leg portions of the operation rods so as to prevent a play in the buckle.

An object of the present invention is to provide a buckle which particularly defines how leg portions of each operation rods are reinforced and how side walls of the buckle main body hold the leg portions of the operation rods, so as to effectively reinforce the leg portions, and the side walls firmly hold the leg portions so as to prevent a play of the buckle.

It is an object of the present invention to provide a buckle in which the insertion body is smoothly inserted to the buckle main body, a play of the buckle at a time of engaging is prevented not only in the side walls and the leg portions in both sides but also in a center portion of the buckle main body and the insertion body, and a stable engaging state is maintained.

The present invention has an object to provide a buckle in which the insertion body can be inserted only in a predetermined direction so as to perform a smooth inserting operation and a proper guiding operation by particularly defining a pair of projections arranged at a center of the insertion body and an interlinking structure with the projections in the buckle main body.

Another object of the present invention is to provide a buckle in which a further stable fitting state can be maintained by particularly defining the interlinking structure between a pair of projections arranged at a center of the insertion body and the operation rods.

In order to achieve the object mentioned above, there is provided a buckle comprising mainly a flat cylindrical buckle main body which is constituted by an upper plate, a lower plate and both side walls, is provided with an insertion port at one end and a belt mounting portion on the other end of the buckle main body, respectively, and is provided with opening portions notched in an arc shape in both side walls, and an insertion body which is provided with a belt engaging rod at one end of a side frame, is provided with a belt folding rod in an inner portion thereof, is provided with a base rod in an inner portion thereof in a horizontal manner, and is provided with flexible operation rods in both sides of the base rod in a projecting manner, wherein an engaged portion is provided in a side of the insertion port of the opening portion in the buckle main body, the operation rods of the insertion body have narrow leg portions arranged in a side of the base rod and bulging head portions capable of being fitted to the opening portions and formed in front ends of the leg portions, hook-shaped engaging portions are provided on the boundary between the leg portions and the bulging head portions, reinforcing ridge portions having a convex cross sectional shape are integrally formed on outer side surfaces of the leg portions so as to reinforce the leg portions, and recess groove portions having a recess cross sectional shape and capable of inserting the reinforcing ridge portions are provided on inner surfaces of the side walls close to the insertion port in the buckle main body, thereby performing a fitting and maintaining operation.

Still preferably, there is provided a buckle, wherein the reinforcing ridge portion formed on the outer side surface of the leg portion in each of the operation rods of the insertion body is provided on all the surface of the leg portion from the base rod to the bulging head portion so as to perform a reinforcing operation, and the recess groove portion is provided on an inner surface from the insertion port to the opening portion in each of the side walls of the buckle main body so as to perform a fitting and maintaining operation.

Further preferably, there is provided a buckle, wherein the pair of projections protruding in an inserting direction are provided in parallel at a center of the base rod of the insertion body, an insertion groove penetrating in a vertical direction is formed between the parallel projections, and protruding portions capable of being fitted to the insertion groove are provided on inner surfaces of the upper plate and the lower plate in the buckle main body in a longitudinal direction in such a manner as to oppose to each other in a vertical direction.

Preferably, there is provided a buckle, wherein the pair of projections provided in parallel to extend from the base rod of the insertion body has a C-shaped horizontal cross sectional shape, a bottom surface of the projection is formed on the same surface with the bottom surface of the operation rod, a height of the projection is set to be higher than that of the operation rod, and recess guide grooves to which the projections are fitted and inserted are formed on both sides of the protruding portions in the inner surface, that is, a ceiling of the upper plate in the buckle main body so as to perform a guiding operation.

Further preferably, there is provided a buckle, wherein the pair of projections provided in parallel to extend from the base rod of the insertion body is formed in such a manner as to set a length protruding from the base rod to be substantially equal to a length of the operation rod so as to perform a stable fitting.

DESCRIPTION OF THE PREFERRED EMBODIMENTS

Hereinafter, an embodiment of a buckle according to the present invention will be particularly described with reference to the accompanying drawings.

Figure 1:
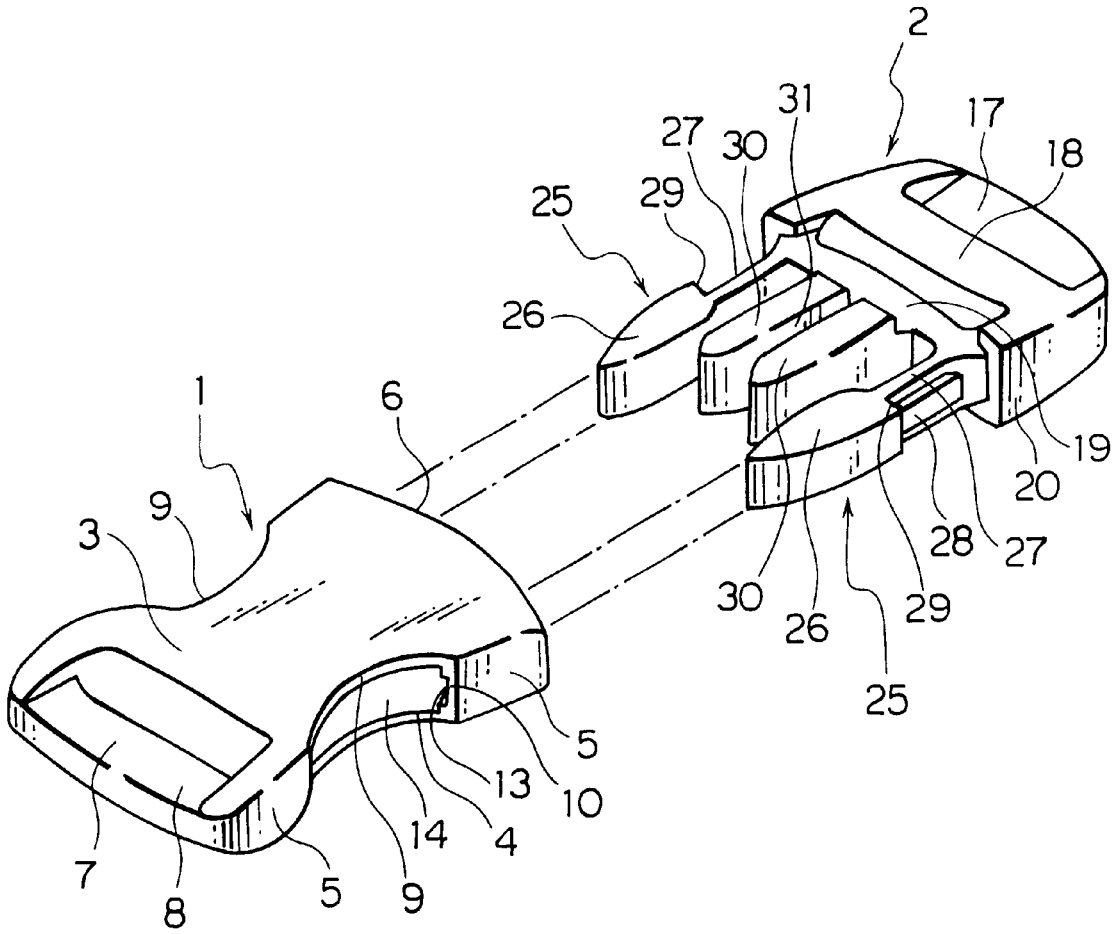
FIG. 1 is a perspective view of a buckle main body and an insertion body in a disengaged state in a buckle according to a first embodiment of the present invention.

A buckle according to the present invention is constituted by a buckle main body 1 and an insertion body 2 as shown in FIG. 1, and is structured such as to freely engage and disengage the insertion body 2 with and from the buckle main body 1. The buckle main body 1 and the insertion body 2 are integrally formed by an injection molding or an extrusion molding, using a thermoplastic resin such as polyacetal, polyamide, polypropylene, polybutylene terephthalate and the like.

In a buckle according to a first embodiment shown in FIGS. 1 to 7, the buckle main body 1 is structured such that a flat cylindrical body is constituted by an upper plate 3, a lower plate 4 and side walls 5, an insertion port 6 and a belt mounting portion 7 are respectively provided at one end and the other end thereof, opening portions 9 cut in an arc shape are provided on both side walls 5, and a portion 10 to be engaged (hereinafter called "engaged portion") engaging portions 29 of flexible operation rods 25 are formed in a side of the insertion port 6 of the opening portions 9. Further, both side walls 5 are formed in such a manner that a distance between both side walls 5 is wide in the side of the insertion port 6 and slightly narrow in the side of the opening portions 9, whereby the insertion body 2 can be automatically disengaged from the buckle main body 1 when pressing the operation rods 25 of the insertion body 2 at a time of engaging. The insertion ports 6 in the upper plate 3 and the lower plate 4 are both formed in a gentle arc shape.

Figure 6:
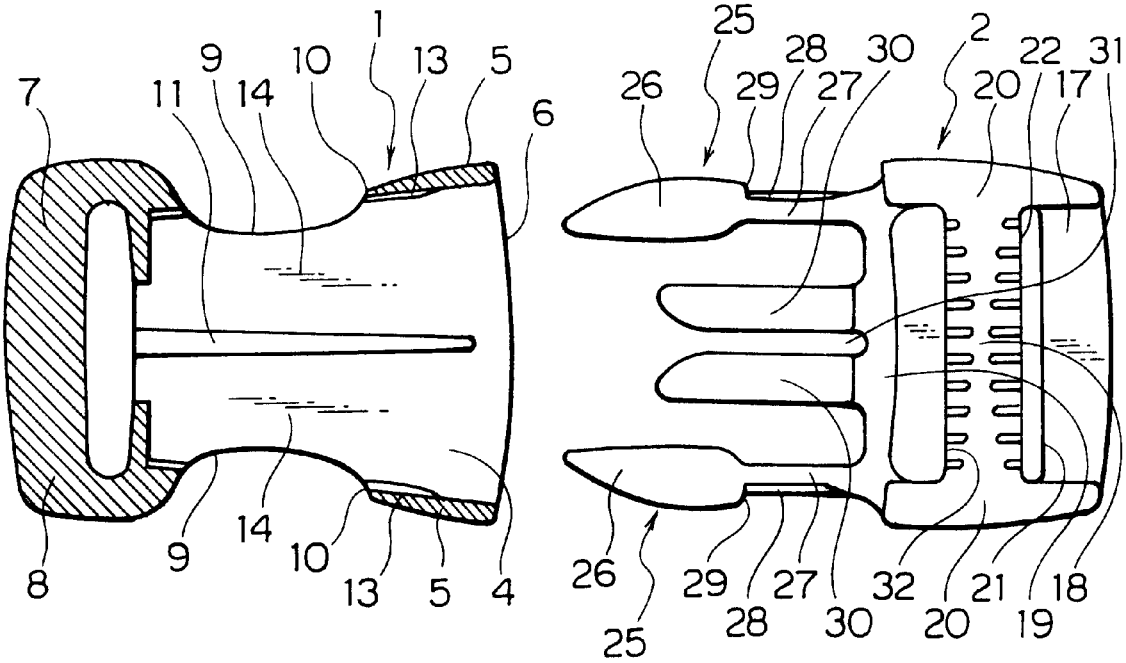
FIG. 6 is a plan view showing the disengaged state between the buckle main body and the insertion body in the buckle in a partly cut-out manner.
Figure 7:
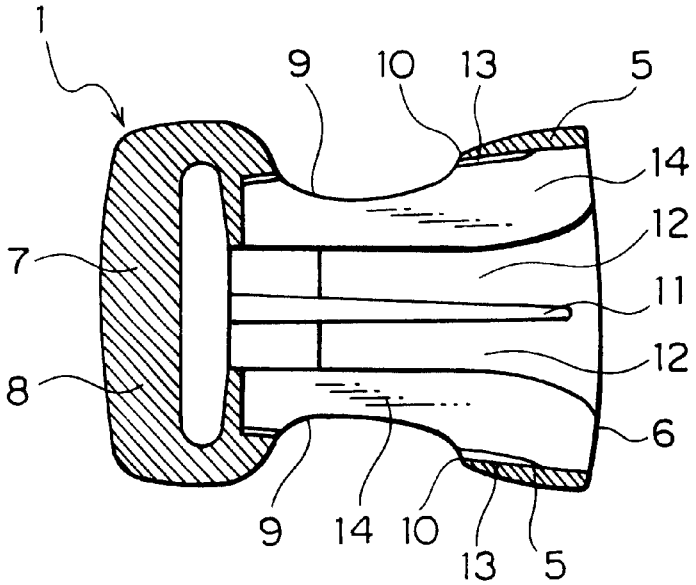
FIG. 7 is a bottom elevational view of the buckle main body in the buckle in a partly cut-out manner.

An inner shape of the buckle main body 1 is structured such that protruding portions 11 protruding in a longitudinal direction at a center on the inner surfaces of the upper plate 3 and the lower plate 4 are provided in such a manner as to oppose to each other in a vertical direction, and the protruding portions 11 are fitted into an insertion groove 31 formed between a pair of projections 30 projected from a base rod 19 of the insertion body 2 in a side of the insertion port 6, as shown in FIGS. 6 and 7. Both sides of the protruding portions 11 are formed on the inner surface of the lower plate 4 so that they are flat and the projections 30 and the operation rods 25 can slide and swing. The inner surface of the upper plate 3 is slightly different from the inner surface of the lower plate 4, deep recess guide grooves 12 for guiding the projections 30 are formed in both sides of the protruding portions 11 as shown in FIG. 7, and hollow portions 14 are formed in the both sides of guide grooves 12 so that the operation rods 25 shallower than the guide grooves 12 can slide and swing.

Figure 4:
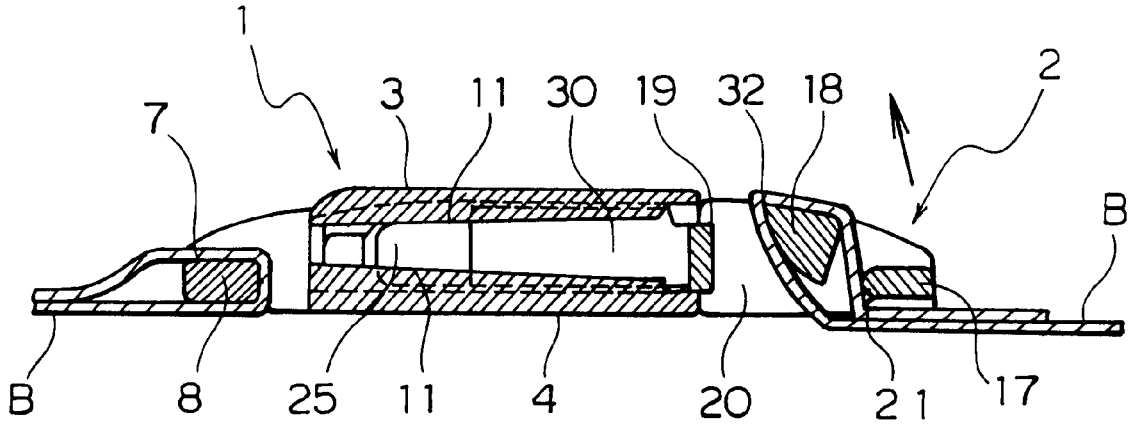
FIG. 4 is a cross sectional view taken along a line A—A in FIG. 3.

The belt mounting portion 7 provided in one end of the buckle main body 1 is structured such that a belt mounting rod 8 having a rectangular cross sectional shape as shown in FIG. 4 is interlinked between both side walls 5 and one end of a belt B is wound around the mounting rod 8 so as to be seamed and fixed thereto. In this case, the belt mounting portion 7 may be structured such that a belt engaging rod 17 is provided in an outer side and a belt folding rod 18 is interlinked between the side walls 5 in an inner side thereof, for example, as in the insertion body 2 shown in FIG. 4 so as to adjust a length of the belt B in place of the structure that the belt B is simply mounted thereto.

On the other hand, the insertion body 2 is structured such that the engaging rod 17 capable of engaging the belt B with one end is interlinked between both side frames 20 as shown in FIG. 4, the folding rod 18 for hooking and folding back the belt B inside the engaging rod 17 is interlinked therebetween, and a base rod 19 is interlinked between the side frames 20 in an inner portion of the folding rod 18. The engaging rod 17 has a J-shaped cross sectional shape, a front end opposing to the folding rod 18 is formed at an acute angle, and an engaging portion 21 capable of engaging the belt B is formed. Further, the belt folding rod 18 has an inverted triangular cross sectional shape, a front end edge 32 opposing to the base rod 19 is formed at an acute angle, and an uneven groove 22 formed in a proper shape is formed on a surface thereof, thereby preventing the belt B from slipping.

The operation rods 25 are projected from both sides of an outer surface of the base rod 19 of the insertion body 2, that is, a surface opposite to the folding rod 18, a flexibility is applied to the operation rods 25 by forming the leg portions 27 in mounting portions to the base rod 19 narrow, and the hook-shaped engaging portions 29 capable of engaging with the engaged portions 10 of the buckle main body 1 are formed in a boundary between the leg portions 27 and bulging head portions 26 by forming each of the bulging head portions 26 having an expanded side surface and a tapered front end at a front end of each of the leg portions 27, thereby sliding and swinging within the hollow portions 14 of the buckle main body 1.

Figure 5:
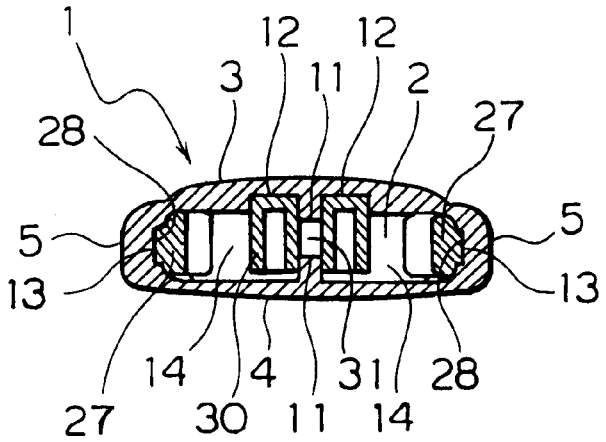
FIG. 5 is a cross sectional view taken along a line B—B in FIG. 3.

Then, reinforcing ridge portions 28 having a convex protruding cross sectional shape are integrally formed on outer side surfaces of the narrow leg portions 27 in the operation rods 25 as shown in FIG. 5 so as to reinforce the leg portions 27, and are inserted and fitted to recess groove portions 13 recessed in the inner surfaces of the side walls 5 of the buckle main body 1, so that the reinforcing ridge portions 28 of the leg portions 27 and the recess groove portions 13 of the side walls 5 are fitted to each other when engaging the engaged portions 10 of the buckle main body 1 with the engaging portions 29 of the insertion body 2 so as to prevent a play in the buckle.

Further, the pair of projections 30 protruding in the same direction as that of the operation rods 25 are provided in the center portion of the base rod 19 in the insertion body 2 in a protruding manner, and each of the projections 30 is structured such that a horizontal cross sectional shape is formed in a C shape as shown in FIG. 5, a bottom surface is on the same surface with the bottom surface of the operation rod 25, a height is greater than that of the operation rod 25, a protruding length is shorter than that of the operation rod 25 and a front end is tapered, thereby being inserted and fitted to the guide groove 12 recessed in both sides of the protruding portions 11 provided on the inner surface of the upper plate 3 in the buckle main body 1 in a protruding manner. The insertion groove 31 penetrating in a vertical direction is provided between the projections 30, and the protruding portions 11 inwardly provided on the upper plate 3 and the lower plate 4 in the buckle main body 1 are fitted and inserted thereto, respectively.

In order to mount the belt B to the insertion body 2, as shown in FIG. 4, one end of the belt B is inserted between the base rod 19 and the folding rod 18 from the lower surface of the insertion body 2, the folding rod 18 is detoured around and hooked, and thereafter the belt B is pulled through the engaging portion 21 of the engaging rod 17, whereby the belt B is engaged by the acute front end edge 32 of the folding rod 18 and the acute engaging portion 21 of the engaging rod 17 and the belt B is mounted to the insertion body 2.

Figure 2:
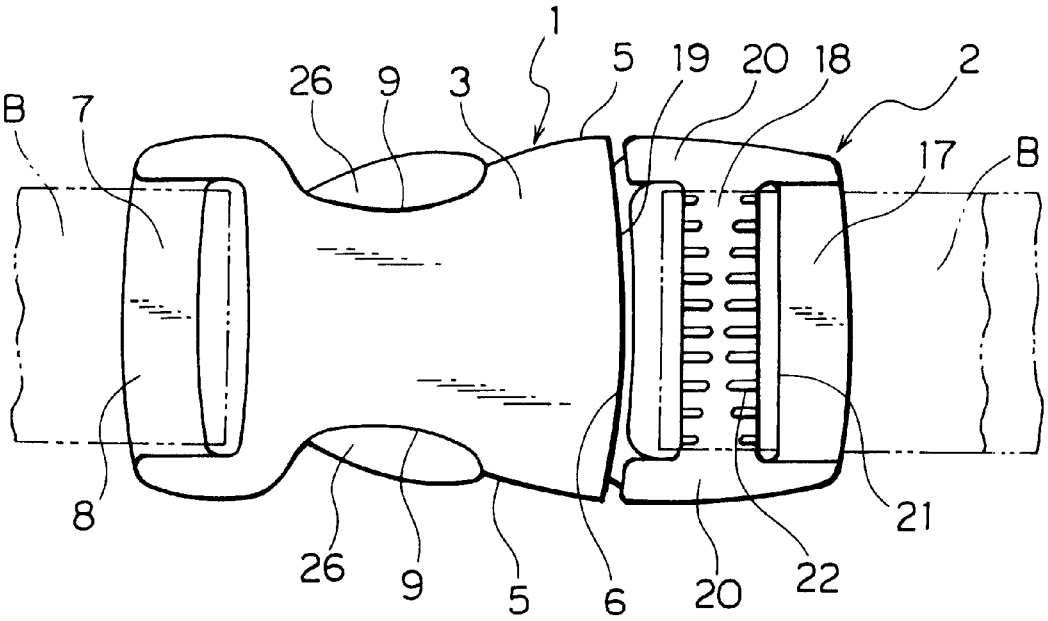
FIG. 2 is a plan view showing an engaged state between the buckle main body and the insertion body in the buckle.
Figure 3:
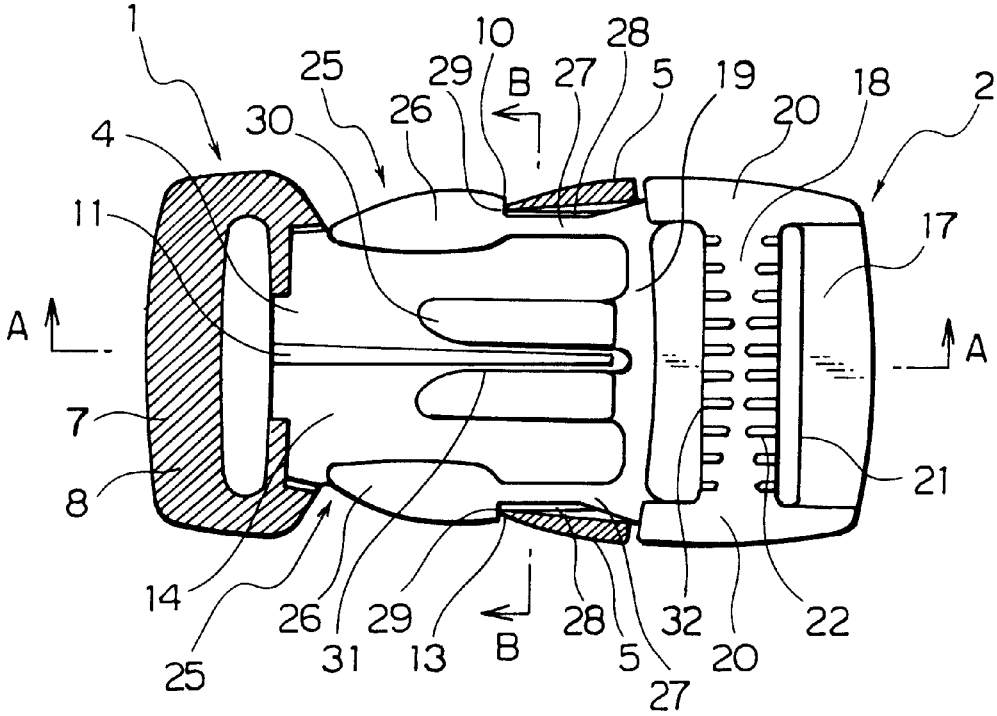
FIG. 3 is a plan view showing the engaged state between the buckle main body and the insertion body in the buckle in such a manner as to partly cut out the buckle main body.

Next, as shown in FIGS. 2 and 3, in order to insert and engage the insertion body 2 to the buckle main body 1, at first when bringing the bulging head portion 26 of the operation rod 25 into contact with the side wall 5 in the insertion port 6 of the buckle main body 1 so as to press, the operation rod 25 is bent and inserted to the hollow portion 14, and after inserting and guiding the protruding portions 11 provided on the inner surfaces of the upper plate 3 and the lower plate 4 to the insertion groove 31 at the same time of inserting the projections 30 to the guide grooves 12 provided on the inner surface of the upper plate 3, the bulging head portions 26 of the operation rods 25 are protruded from the opening portions 9, whereby the engaging portions 29 and the engaged portions 10 are engaged with each other, and the reinforcing ridge portions 28 protruded from the outer surfaces of the leg portions 27 are fitted to the recess groove portions 13 recessed in the side walls 5, so that the buckle main body 1 and the insertion body 2 are set.

In order to disengage the insertion body 2 from the buckle main body 1, when pressing and bending the bulging head portions 26 of the operation rods 25 in an inward direction, an engagement between the engaging portions 29 and the engaged portions 10 is released, the reinforcing ridge portions 28 of the leg portions 27 are simultaneously taken out from the recess groove portions 13 of the side walls 5, and the bulging head portions 26 are automatically drawn out along the side walls 5 expanded in the side of the insertion port 6, so that the buckle main body 1 and the insertion body 2 are disengaged and separated.

In the case of loosening the belt in a state that the buckle main body 1 and the insertion body 2 are engaged, for example, as shown in FIG. 4, the insertion body 2 is lifted up, with the end portion of the belt mounting portion 7 of the buckle main body 1 as supporting point, in a direction of the arrow, whereby the belt B is in a parallel state between the engaging rod 17 and the folding rod 18, that is, the belt B is automatically loosened when the belt B is arranged in a linear manner without being bent at the engaging portion 21 of the engaging rod 17. Further, when it is desired to tighten the belt, it is possible to easily tighten the belt by pulling the belt end portion in the upper side in a state of lifting up the insertion body 2 as mentioned above.

Figure 8:
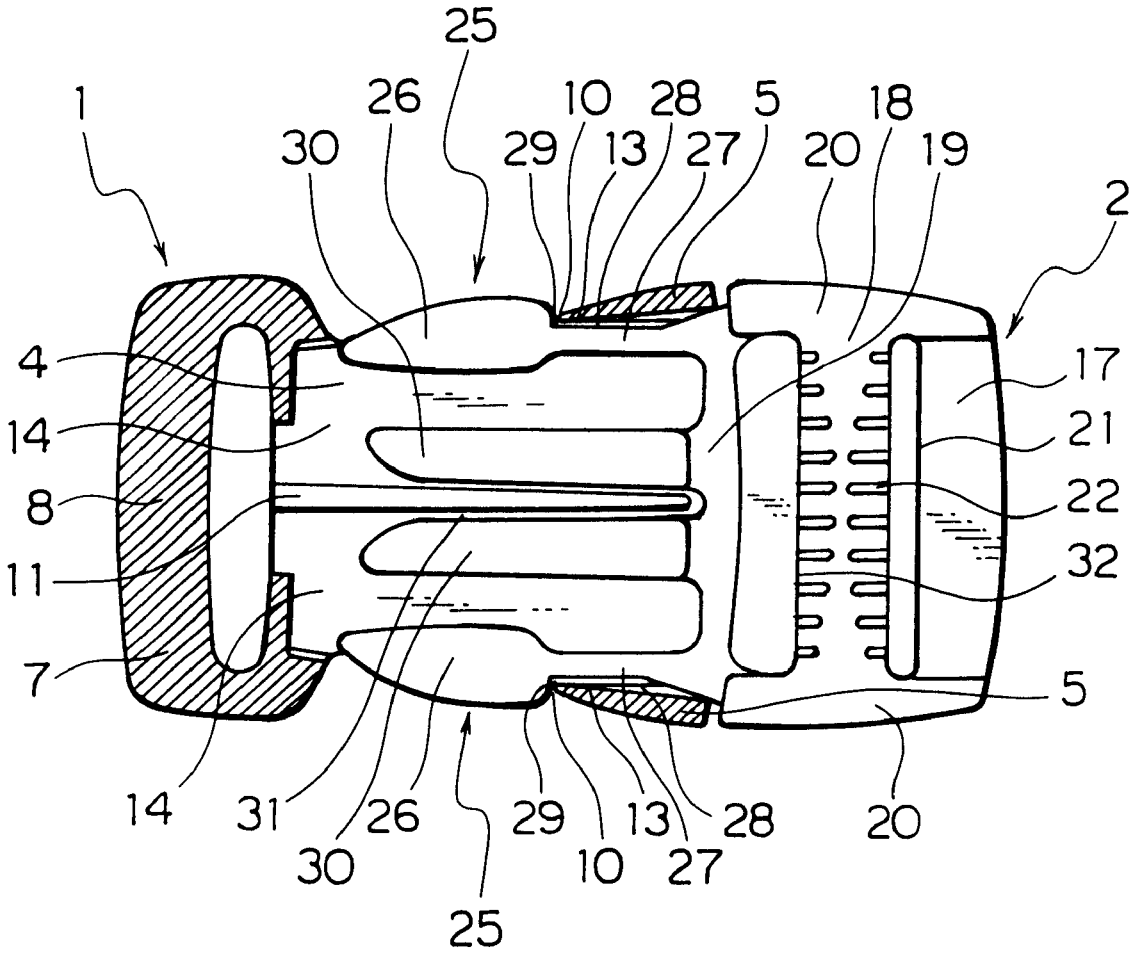
FIG. 8 is a plan view showing an engaged state between a buckle main body and an insertion body in a buckle in such a manner as to partly cut out the buckle main body according to a second embodiment of the present invention.

A buckle according to a second embodiment of the present invention as shown in FIG. 8 is different from the buckle according to the first embodiment in view of a structure of a pair of projections 30. That is, a pair of projections 30 provided at the center of the base rod 19 of the insertion body 2 are structured such that a protruding length of the projections 30 is set to be substantially equal to the length of the operation rods 25 in the both sides and the guide grooves 12 inwardly provided on the upper plate 3 of the buckle main body 1 are formed in correspondence to these projections 30 so as to obtain a stable buckle. The other structures except the structure mentioned above are the same as those of the buckle according to the first embodiment, and the operation of the buckle is the same as that of the first embodiment.

Figure 9:
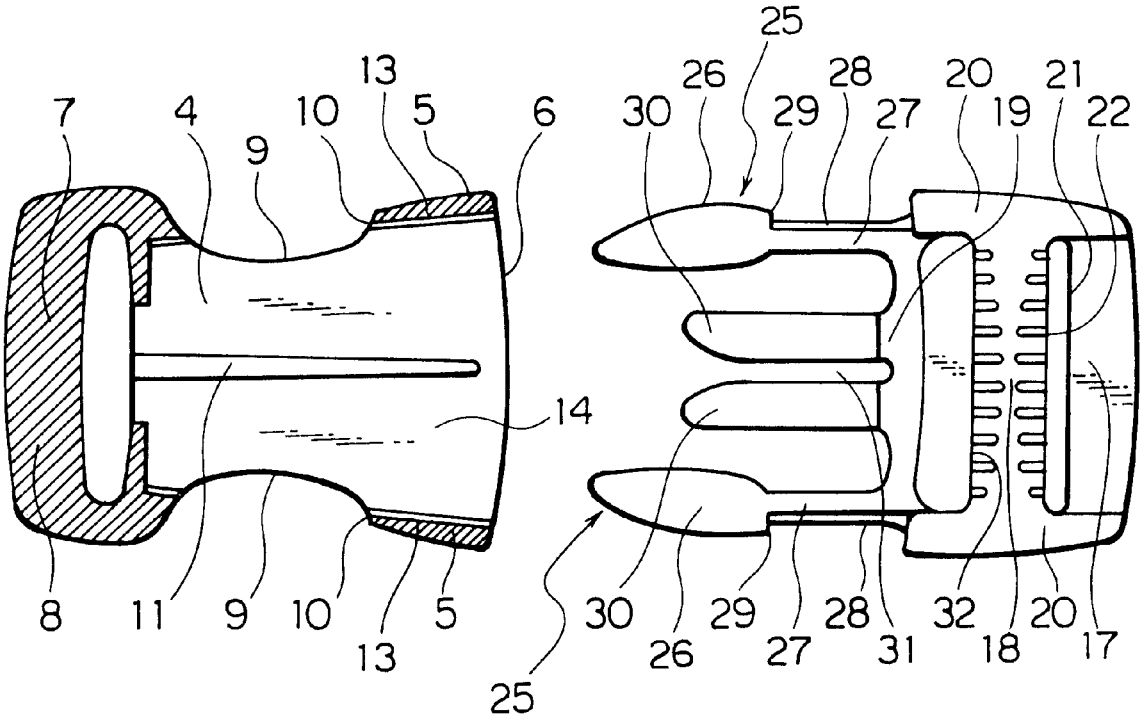
FIG. 9 is a plan view showing a disengaged state between a buckle main body and an insertion body in a buckle according to a third embodiment of the present invention in a partly cut-out manner.
Figure 10:
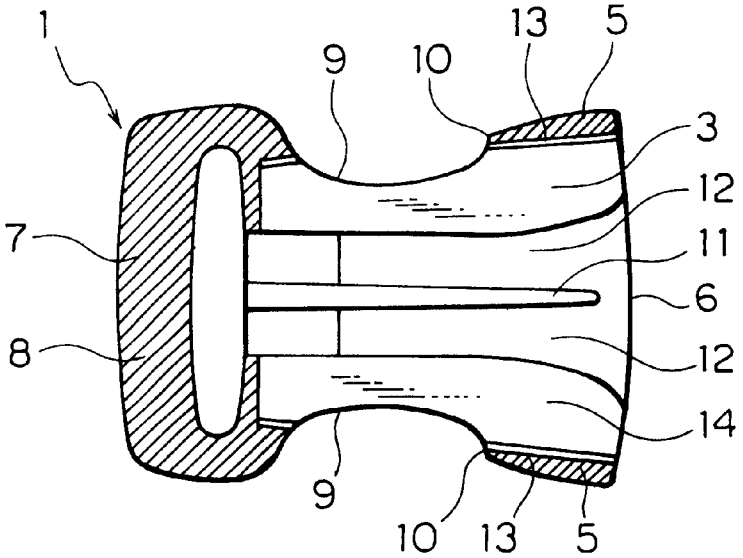
FIG. 10 is a bottom elevational view of the buckle main body in the buckle in a partly cut-out manner.
Figure 11:
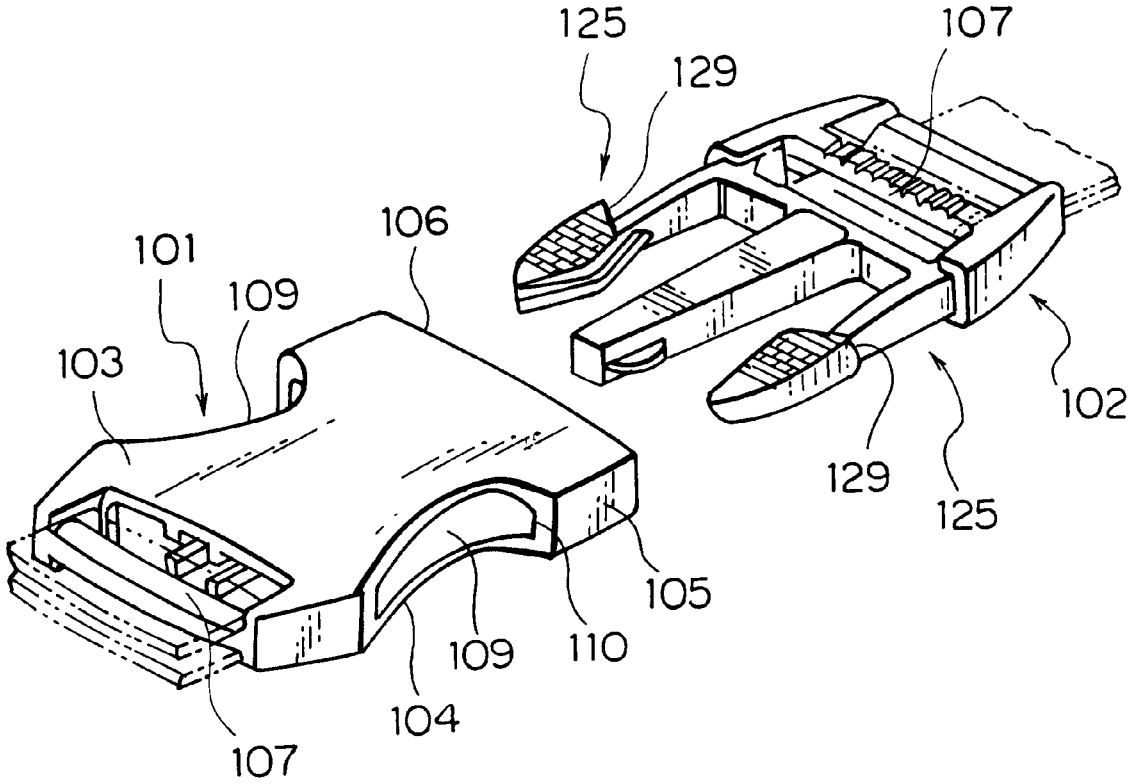
FIG. 11 (PRIOR ART)
FIG. 11 is a perspective view of a buckle main body and an insertion body in a disengaged state of a known buckle.
Figure 12:
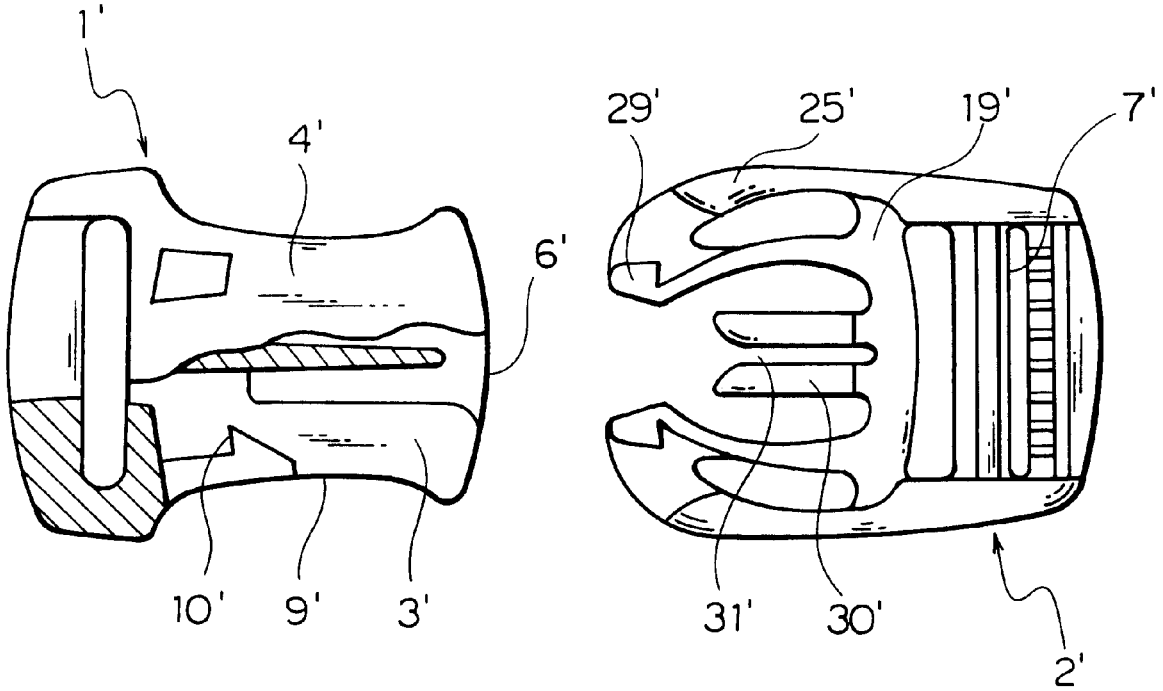
FIG. 12 (PRIOR ART)
FIG. 12 is a bottom elevational view of a buckle main body and an insertion body in a disengaged state of the other known buckle in a partly cut-out manner.

A buckle according to a third embodiment of the present invention as shown in FIGS. 9 and 10 is different from the buckle according to the first embodiment in view of the following point. That is, a structure of the recess groove portions 13 provided on the inner surfaces of the side walls 5 in the buckle main body 1 and a structure of the reinforcing ridge portions 28 projected from the outer side surfaces of the leg portions 27 of the operation rods 25 in the insertion body 2 are slightly different from the structure of the first embodiment. The other structures, except the structure mentioned above, are the same as those of the buckle according to the first embodiment.

The side walls 5 of the buckle main body 1 are structured such that the recess groove portions 13 recessed on the inner surface are provided all along the length of the side walls 5, and the reinforcing ridge portions 28 protruded from the outer side surfaces of the leg portions 27 of the operation rods 25 in the insertion body 2 are provided all along the length of the leg portions 27 from base portions of the operation rods 25 and the side frames 20 in the side surfaces of the base rods 19 to the engaging portions 29 of the bulging head portions 26 in a protruding manner, thereby forming the fitting state between the outer side surfaces of the leg portions 27 and the inner surfaces of the side walls 5 stronger.

The buckle according to the present invention is structured in the manner mentioned above, and the following effects can be obtained by the structure.

There is provided a buckle comprising a flat buckle main body 1 which is constituted by an upper plate 3, a lower plate 4 and both side walls 5, is provided with an insertion port 6 and a belt mounting portion 7 at one end and the other, respectively, and is provided with opening portions 9 in both side walls 5, and an insertion body 2 which is provided with a belt engaging rod 17 at one end of a side frame 20, is provided with a belt folding rod 18 in an inner portion thereof, is provided with a base rod 19 in an inner portion thereof in a horizontal manner, and is provided with flexible operation rods 25 in both sides of the base rod in a projecting manner, wherein an engaged portion 10 is provided in a side of the insertion port 6 of the opening portion 9, the operation rods 25 have narrow leg portions 27 arranged in a side of the base rod 19 and bulging head portions 26 fitted to the opening portions 9 and formed in front ends of the leg portions 27, engaging portions 29 are provided on the boundary between the leg portions 27 and the bulging head portions 26, reinforcing ridge portions 28 having a convex cross sectional shape are formed on outer side surfaces of the leg portions 27, and recess; groove portions 13 having a recess cross sectional shape and capable of inserting the reinforcing ridge portions 28 are provided on inner surfaces of the side walls 5 close to the insertion port 6. Accordingly, the leg portions 27 in the operation rods 25 of the buckle main body 1 is reinforced from the outer side surfaces, a crack or a breakage from the engaging portions 29 is prevented, the side walls 5 of the buckle main body 1 firmly hold the leg portions 27 in the operation rods 25 so as to prevent a play in the buckle.

There is provided a buckle, wherein the reinforcing ridge portion 28 formed on the outer side surface of each of the leg portions 27 is provided near the engaging portion 29 in the side of the bulging head portion 26 of the leg portion 27, and the recess groove portion 13 is provided in a part of the side wall 5 in the side of each of the opening portions 9. Accordingly, the reinforcement of the leg portions is limited to the portion near the engaging portions 29 in the operation rods 25 to a minimum limit, and a crack and a breakage in the operation rods 25 and a play in the buckle are effectively prevented and the inserting operation can be easily performed.

There is provided a buckle, wherein the reinforcing ridge portion 28 formed on the outer side surface of each of the leg portions 27 is provided on all the surface of the leg portion 27 from the base rod 19 to the bulging head portion 26, and the recess groove portion 13 is provided on the inner surface from the insertion port 6 to the opening portion 9 in each of the side walls 5. Accordingly, the buckle is suitable for a buckle which requires a firm operation rod 25 and a durable buckle can be produced since the fitting range between the leg portions 27 of the operation rods 25 and the side walls 5 of the buckle main body 1 is large.

There is provided a buckle, wherein a pair of projections 30 are provided at the center of the base rod 19 of the insertion body 2 in a parallel manner, an insertion groove 31 is formed therebetween, and protruding portions 11 capable of being fitted to the insertion grooves 31 are provided on inner surfaces of the upper plate 3 and the lower plate 4 in the buckle main body 1 in a longitudinal direction in such a manner as to oppose to each other in a vertical direction. Accordingly, a guiding performance by the inserting operation between the buckle main body 1 and the insertion body 2 is improved, and further since a play of the buckle at a time of inserting is prevented riot only in the side walls 5 and the leg portions 27 in both sides but also in the center portion of the buckle, a stable buckle can be obtained.

There is provided a buckle, where the pair of projections 30 have a C-shaped horizontal cross sectional shape, have the same bottom surface as that of the operation rod 25, a height thereof is set to be higher than that of the operation rod 25, and the recess guide grooves 12 to which the projections 30 can be fitted and inserted are formed at both sides of the protruding portions 11 on the inner surfaces of the upper plate 3 in the buckle main body 1. Accordingly, the insertion body 2 inserted to the buckle main body 1 employs an insertion method only in a predetermined direction and cannot be inserted in both surfaces. Therefore, since the buckle is not erroneously inserted, the twisting operation of the belt can be previously prevented and the guiding performance for the inserting operation can be improved.

There is provided a buckle, wherein the pair of projections 30 are formed in such a manner as to set a length protruding from the base rod 19 to be substantially equal to the length of the operation rod 25. Accordingly, a play of the buckle can be further prevented, and the buckle being stable, durable and with improved guiding performance can be produced. Therefore, the present invention can provide significantly excellent effects.

What is claimed is:

1. A buckle comprising a buckle main body which is constituted by an upper place, a lower plate and side walls, which is provided with an insertion port at one end and a belt mounting portion at the other, respectively, and which is provided with opening portions in the side walls, and an insertion body which is provided with a belt engaging rod at one end of a side frame, which is provided with a belt folding rod in an inner portion thereof, which is provided with a base rod in an inner portion thereof, and which is provided with flexible operation rods in both sides of the base rod in a projecting manner, wherein an engaged portion is provided in a side of the insertion port of the opening portion, the operation rods having narrow leg portions arranged in a side of the base rod and bulging head portions fitted to the opening portions and formed in front ends of the leg portions, wherein engaging portions are provided on the boundary between the leg portions and the bulging head portions, reinforcing ridge portions having a convex cross sectional shape are formed on outer side surfaces of the leg portions, and recess groove portions having a recess cross sectional shape and capable of inserting the reinforcing ridge portions are provided on inner surfaces of the side walls close to the insertion port, wherein each reinforcing ridge portion is formed on the outer side surface of each of the leg portions on all of the surfaces of the leg portions from the base rod to substantially the bulging head portion, and the recess groove portion is provided on the inner surface from substantially the insertion port to substantially the opening portion in each of the side walls.

2. A buckle according to claim 1, wherein a pair of projections are provided at the center of the base rod of the insertion body in a parallel manner in an inserting direction, an insertion groove is formed therebetween, and protruding portions capable of being fitted to said insertion groove are provided on inner surfaces of the upper plate and the lower plate in the buckle main body in a longitudinal direction in such a manner as to oppose to each other in a vertical direction.

3. A buckle according to claim 2, wherein the pair of projections have a C-shaped horizontal cross sectional shape, have the same bottom surface as that of the operation rod, a height thereof is set to be higher than that of the operation rod, and recess guide grooves to which the projections are fitted and inserted are formed at both sides of the protruding portions on the inner surfaces of the upper plate the buckle main body.

4. A buckle according to claim 2 or 3 wherein the pair of projections are formed in such a manner as to set a length protruding from the base rod to be substantially equal to the length of the operation rod.

5. A buckle comprising a buckle main body which is constituted by an upper plate, a lower plate and side walls, which is provided with an insertion port at one end and a belt mounting portion at the other, respectively, and which is provided with opening portions in the side walls, and an insertion body which is provided with a belt engaging rod at one end of a side frame, which is provided with a belt folding rod in an inner portion thereof, which is provided with a base rod in an inner portion thereof, and which is provided with flexible operation rods in both sides of the base rod in a projecting manner, wherein an engaged portion is provided in a side of the insertion port of the opening portion, the operation rods having narrow leg portions arranged in a side of the base rod and bulging head portions fitted to the opening portions and formed in front ends of the leg portions, wherein engaging portions are provided on the boundary between the leg portions and the bulging head portions, reinforcing ridge portions having a convex cross sectional shape are formed on outer side surfaces of the leg portions, and recess groove portions having a recess cross sectional shape and capable of inserting the reinforcing ridge portions are provided on inner surfaces of the side walls close to the insertion port, wherein each reinforcing ridge portion is formed on the outer side surface of each of the leg portions from the engaging portion in the side of the bulging head portion of each of the leg portions to a part of each of the leg portions, and each recess groove portion is provided in a part of the side wall in the side of each of the opening portions.

* * * * *